US009618008B2

(12) United States Patent
Porodo et al.

(10) Patent No.: US 9,618,008 B2
(45) Date of Patent: Apr. 11, 2017

(54) GAS TURBINE DIFFUSER BLOWING METHOD AND CORRESPONDING DIFFUSER

(75) Inventors: Jérôme Yves Félix Gilbert Porodo, Pau (FR); Laurent Pierre Tarnowski, Pau (FR)

(73) Assignee: TURBOMECA, Bordes (FR)

( * ) Notice: Subject to any disclaimer, the term of this patent is extended or adjusted under 35 U.S.C. 154(b) by 744 days.

(21) Appl. No.: 14/117,747

(22) PCT Filed: May 15, 2012

(86) PCT No.: PCT/FR2012/051087
§ 371 (c)(1),
(2), (4) Date: Jan. 6, 2014

(87) PCT Pub. No.: WO2012/156640
PCT Pub. Date: Nov. 22, 2012

(65) Prior Publication Data

US 2014/0105723 A1 Apr. 17, 2014

(30) Foreign Application Priority Data

May 16, 2011 (FR) ..... 11 54211

(51) Int. Cl.
*F04D 29/44* (2006.01)
*F04D 29/68* (2006.01)
*F04D 27/02* (2006.01)

(52) U.S. Cl.
CPC ..... *F04D 29/441* (2013.01); *F04D 29/444* (2013.01); *F04D 29/682* (2013.01);
(Continued)

(58) Field of Classification Search
CPC ..... F04D 29/44; F04D 29/441; F04D 29/444; F04D 29/68; F04D 29/681; F04D 29/682;
(Continued)

(56) References Cited

U.S. PATENT DOCUMENTS 2,084,463 A 6/1937 Stalker et al.
2,399,072 A 4/1946 Thompson
(Continued)

FOREIGN PATENT DOCUMENTS

EP 2 169 237 A2 3/2010
FR 963 540 7/1950
(Continued)

OTHER PUBLICATIONS

English translation of Notice of Rejection issued Mar. 1, 2016 in Japanese Patent Application No. 2014-510863.
(Continued)

*Primary Examiner* — Christopher Verdier
*Assistant Examiner* — Brian O Peters
(74) *Attorney, Agent, or Firm* — Oblon, McClelland, Maier & Neustadt, L.L.P.

(57) ABSTRACT

A diffuser of a compressor of centrifugal or mixed type includes two end plates which enclose a plurality of regularly distributed circumferential blades, and at least one transverse upstream passage produced in lower or upper surfaces of the blades. An injection/withdrawal coupling is achieved by a recirculation of a stream in an air passage of the diffuser on the basis of injection of air from at least one point in a leading edge zone of an upstream side of the diffuser. Blowing of air is then effected in at least one groove formed along a lateral flank of each blade by withdrawal of the air stream in a region of a trailing edge. Thereby, effectively separation of the air in a boundary layer in a gas turbine compressor diffuser is realized by re-energizing the boundary layer with air at a higher pressure by a suction/re-injection coupling.

13 Claims, 7 Drawing Sheets

(52) U.S. Cl.
CPC ..... *F04D 29/684* (2013.01); *F04D 27/023* (2013.01); *F04D 27/0238* (2013.01); *F05D 2240/122* (2013.01); *F05D 2250/52* (2013.01)

(58) Field of Classification Search
CPC .... F04D 29/684; F04D 27/02; F04D 27/0207; F04D 27/023; F04D 27/0238
See application file for complete search history.

(56) References Cited

U.S. PATENT DOCUMENTS

| | | | | |
|---|---|---|---|---|
| 4,414,815 | A * | 11/1983 | Conrad | F02C 7/2365 415/914 |
| 2008/0038112 | A1 | 2/2008 | Spakovszky et al. | |
| 2008/0118341 | A1 | 5/2008 | Joco et al. | |

FOREIGN PATENT DOCUMENTS

| | | | |
|---|---|---|---|
| FR | 1326166 | * | 6/1962 |
| JP | 54-127013 | A | 10/1979 |
| JP | 54-133613 | A | 10/1979 |
| JP | 56-9696 | A | 1/1981 |
| JP | 59-211798 | A | 11/1984 |
| JP | 1-174599 | U | 12/1989 |
| JP | 6-76697 | U | 10/1994 |
| JP | 2005-163691 | A | 6/2005 |

OTHER PUBLICATIONS

International Search Report Issued Sep. 24, 2012 in PCT/FR12/051087 Filed May 15, 2012.

* cited by examiner

GAS TURBINE DIFFUSER BLOWING METHOD AND CORRESPONDING DIFFUSER

TECHNICAL FIELD

The invention relates to a method of blowing air in a compression stage diffuser of a gas turbine, in particular in compressors of the centrifugal or mixed type. A mixed compressor may be understood to be a compressor structured at the impeller outlet such that the air stream forms an angle of between 0 and 90° relative to a radial direction. The invention also relates to a compressor diffuser suitable for implementing such a process.

The field of the invention is that of operation of compressors and improvement of their performance, in particular of the surge margin. The performance is in particular sensitive to the air flow coming from the impeller of the compressor. The diffuser has the function of adjusting this flow in order to optimise the transformation of the dynamic air pressure into static pressure.

In general, a diffuser is composed of inclined blades in a space formed between two end plates. The deviation produced by the blades can cause air flow separations on the lower or upper surface of the blades. Such separations can lead to detachment of the air streams and, if the phenomenon increases, to surging.

It is therefore necessary to maintain a sufficient surge margin in order to avoid the very detrimental consequences of surging, which may even lead to the destruction of components of the compressor.

PRIOR ART

Hitherto, in order to attempt to stabilise the air flow and to avoid surging, a portion of the air could be taken in the air passage upstream of the diffuser blades by diverting some of the air at the outlet of the impeller and by re-injecting it in the region of the end plates of the diffuser, for example according to the method described in the patent U.S. Pat. No. 6,699,008. But this system is not optimal, since if the reintroduction of air into the diffuser can improve the stability of the compressor, diverting the air at the outlet of the impeller can cause new problems of stability. Moreover, to effect a reintroduction without generating additional losses is difficult, because the air at the outlet of the impeller is at a lower static pressure level than that of the re-injection site.

It is also known to produce cavities in the upper surfaces of blades in order to use it as a cooling fluid as described in the document U.S. Pat. No. 6,210,104. The patent document FR 2937385 in the name of the applicant describes an improvement to this solution by a progressive increase of the cross-section of the cavities between the intake orifice and the outlet orifice. Then the intake of the fluid is homogenised on the blades. However, it may prove necessary to discharge outside this collected air to the exterior, which is prejudicial to the overall balance of the cycle.

Other solutions provide a recirculation of air coming from orifices formed close to the leading edges of the vanes then redirected into the air passage upstream of the leading edges in an axially symmetrical manner. The patent EP 2169237 implements such an arrangement in order to reduce the separations with an intake of air over the blades, like the aforementioned patents U.S. Pat. No. 6,210,104 and FR 2937385. The reintroduction which is effected upstream of the blades of the diffuser only affects the incidence on the leading edge of the diffuser.

DESCRIPTION OF THE INVENTION

The invention seeks to combat more effectively the separation of the boundary air layer by actively stabilising this layer. In order to do this, the invention provides for re-energising the boundary layer with air at a higher pressure by a blowing/suction coupling.

More precisely the present invention relates to a method of blowing air into a compression stage diffuser of a compressor of a gas turbine. Such a diffuser includes two end plates enclosing a plurality of circumferential blades. The air flow along the blades is effected from a leading edge to a trailing edge of the diffuser. In this method, coupling of an injection of air into the air passage upstream of the diffuser is carried out with a withdrawal of air originating from the downstream air passage via an air intake at the leading edges, upstream relative to the trailing edges situated downstream. Blowing of the injected air occurs in the air passage from upstream to downstream via this air intake. The injection is oriented so that the injected air blows into the air passage along the blades and/or the end plates. Withdrawal of this air is then effected by suction into the air passage at the trailing edges, so that the pressure of the air withdrawn is substantially higher than the pressure of air flowing in the region of the withdrawal. Thus, the transition from a laminar boundary layer of the air flow to a turbulent layer is initiated and/or reinforced by an increase in its energy level.

The injection may be oriented from 0° to approximately ±90° relative to a normal to the injection face. Air is advantageously injected as tangentially as possible to the injection face in the direction of the air flow. Thus, the transition from a laminar boundary layer of the air flow to a turbulent layer is initiated and/or reinforced by an increase in its energy level.

Such blowing therefore makes it possible to "stabilise" a boundary layer by making it turbulent when it is laminar, and thus to delay the separations since a turbulent boundary layer is intrinsically more stable than a laminar boundary layer. When the boundary layer is turbulent, this supply of energy delays the appearance of separations. In addition, even if the separation of the air flow is already initiated, the supply of energy can likewise enable the reattachment of the boundary layer.

The phenomenon of re-energisation according to the invention can be reinforced by the "coanda" effect which appears when a jet of air is situated close to a convex wall. This effect results in attraction of the fluid towards the wall. This "coanda" effect can be maximised depending upon the speed and the angle of ejection of the air in the region of the withdrawal.

According to advantageous embodiments, the method according to the invention provides for withdrawing air either downstream of the diffuser, in a subsequent grille of the stage or in a subsequent stage, or in the diffuser concerned, in particular near to the trailing edge of the blades.

In the event that air is withdrawn in the diffuser, according to more particular embodiments:

- the withdrawal of air can be performed on the lower and/or upper surface of the blades, and the blowing can be performed on the lower and/or upper surface of the blades;

the withdrawal can be performed on the end plates of the hub and/or housing of the diffuser, and the blowing can be performed on the end plates;

the withdrawal can be performed on the blades and the blowing can be performed on the end plates or vice versa (by a withdrawal on the end plates and blowing on the blades);

the speed of ejection of the air during injection thereof is chosen between Mach 0.7 and 1, and the angle of ejection is chosen between 60° and 90° with respect to a normal to the injection face of the blades and/or intake end plates, in order to maximise the coanda effect.

The invention also relates to a diffuser suitable for carrying out such a method. Such a diffuser of a compressor of the centrifugal or mixed type includes two end plates enclosing a plurality of circumferential blades. At least one upstream transverse passage is produced in the lower and/or upper surface of blades and/or in an end plate in at least one point for injection of air into the air passage, situated in the leading edge zone of the upstream side of the diffuser, in the compression direction of the gas turbine. This passage is capable of forming an injection/withdrawal coupling in the air passage by a recirculation in the diffuser and/or along the end plate outside the diffuser. The withdrawal of air at at least one point in the trailing edge zone of the downstream side of the diffuser is carried out by suction in at least one groove formed along a flank of the blades and/or in the internal face of the end plate.

According to some preferred embodiments:

the injection is carried out by at least one transverse upstream passage which is produced in the lower and/or upper surface of the blades and which opens into the groove of the blades and/or into the internal face of the end plate;

the transverse downstream and upstream passages are formed by cavities and/or slots;

the passages have a central axis inclined with respect to a normal to the face onto which it opens, with an angle substantially between 0 and ±90°, preferably an angle close to 90° for the upstream passages and close to 0° for the downstream passages;

the passages can be positioned substantially over the entire length of each groove, at the upper and/or lower surface, with one upstream passage and one downstream passage per groove;

the groove has a constant width or evolves linearly as a function of the curvilinear abscissa of each blade;

the groove opens in the trailing edge and the trailing edge therefore has curved rims in order to promote the suction;

the groove extends over substantially between 1 and 100% of the length of each blade;

there are at least two grooves, which are disposed successively or parallel along each blade.

DESCRIPTION OF THE DRAWINGS

Other details, characteristics and advantages of the present invention will become clearer by reading the following description, which is not limited, with reference to the appended drawings, in which, respectively.

DETAILED DESCRIPTION

The terms "downstream" and "upstream" qualify positions with respect to the flow of the air streams. In all the drawings, identical reference signs refer to the passages in the description in which the elements corresponding to these reference signs are defined.

Figure 1:
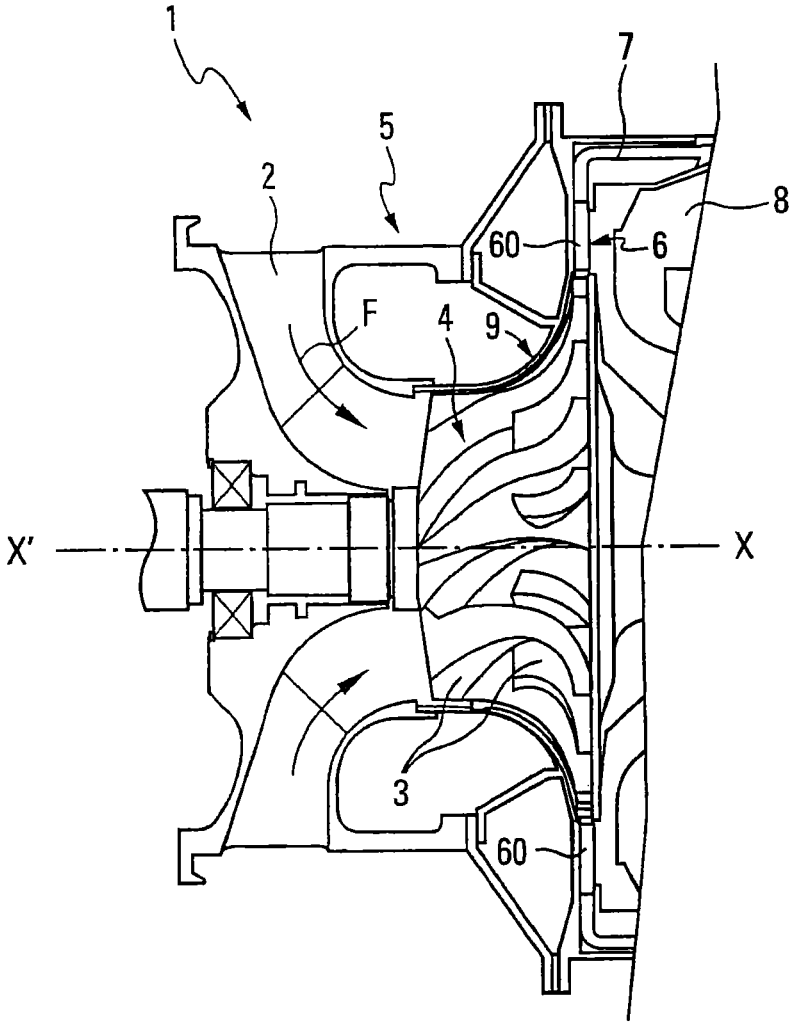
FIG. 1 shows a schematic partial sectional view of a gas turbine including an air diffuser.

With reference to the schematic view in partial cross-section of a gas turbine 1 of a helicopter according to FIG. 1, an air stream F is first of all drawn into a fresh air inlet duct 2, then compressed between the vanes 3 of an impeller 4 of a centrifugal compressor 5 and a cover 9. The turbine is axially symmetrical about the axis X'X.

The compressor 5 is centrifugal here and the compressed stream F then comes out of the impeller 4 radially. When the compressor is mixed, the flow comes out inclined at an angle of between 0° and 90° relative to a radial direction, perpendicular to the axis X'X.

The stream F then passes through a diffuser 6 formed at the outlet of the compressor 4, in order to be adjusted and routed towards inlet channels 7 of the combustion chamber 8.

In order to effect this adjusting, the diffuser 6 is composed of a plurality of curved blades 60 formed between two end plates on the periphery of the impeller 4—in this case radially—and therefore rotating about the axis X'X.

Figure 2A:
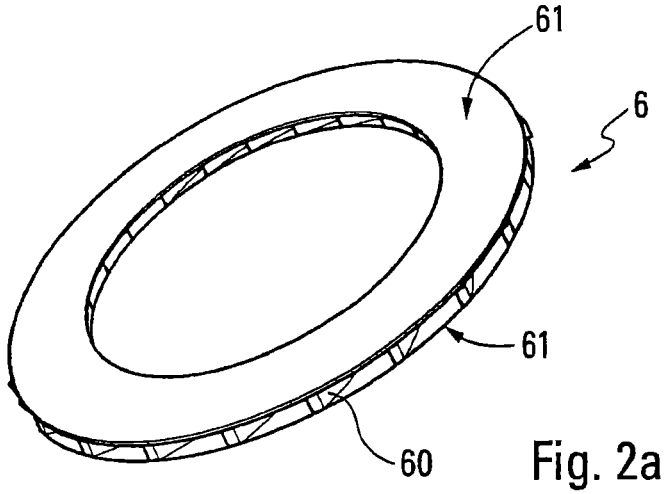
FIGS. 2*a* to 2*c* show perspective views of a diffuser with blades with one and two end plates, as well as that of an isolated blade (FIG. 2*c*)
Figure 2C:
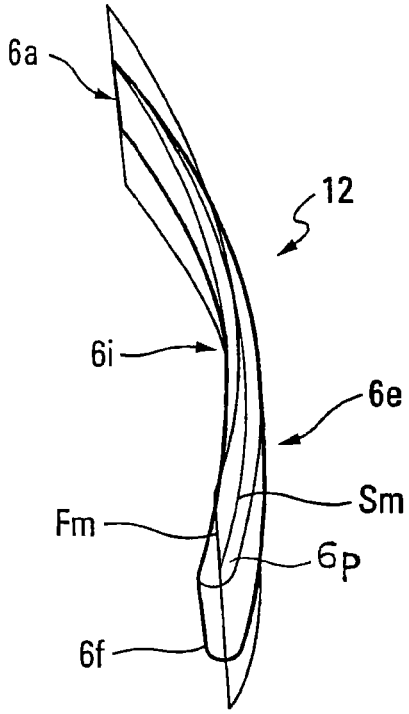
Figure 2B:
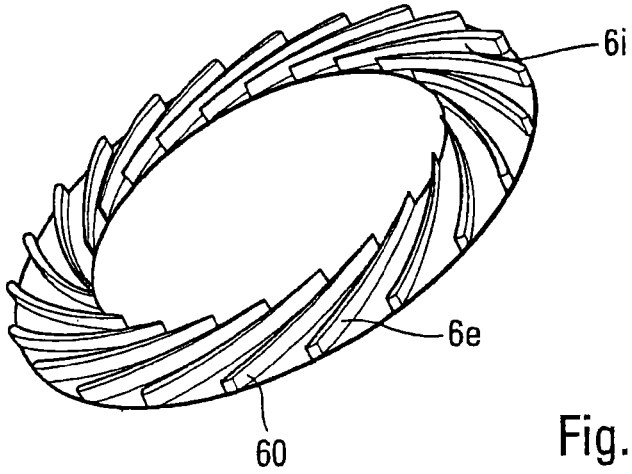

FIG. 2*a* shows more precisely a perspective view of the diffuser 6 with blades 60 joined to two end plates 61. In FIG. 2*b*, where an end plate has been omitted for greater clarity, each blade 60 has in a known manner a face known as the upper surface 6*e* and a face known as the lower surface 6*i*. As illustrated more precisely on the blade 60 of FIG. 2*c*, these upper and lower surfaces 6*e* and 6*i* extend longitudinally and substantially parallel to a mean surface Fm of the blade. In the illustrated example, these faces are connected by a tapered leading edge 6*a* and a rounded trailing edge 6*f* in the direction of flow of the air streams. Transversely with respect to the upper and lower surface, each blade 60 has planar flanks 6*p* joined to the end plates 61.

The blades exhibit a progression of thickness between their flanks 6*p*, which is sufficient to form grooves there as described below. This thickness can attain a few millimetres over 20% to 100% of the mean curvilinear abscissa Sm of the blade 60 along the mean surface Fm.

With the aid of FIGS. 3*a* and 3*b*, a first embodiment of a diffuser with withdrawal and blowing of air on a blade will now be described.

Figure 3A:
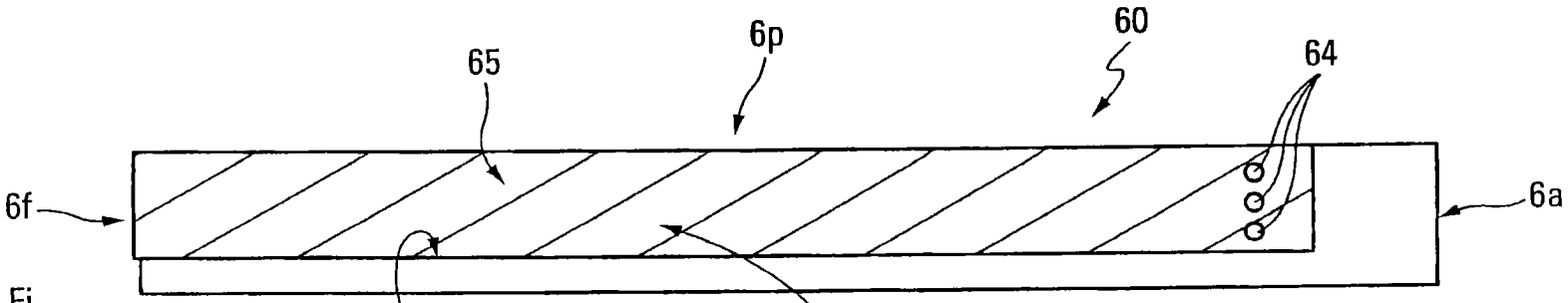
FIGS. 3*a* and 3*b* show schematic views in longitudinal section and from above of a first example of a diffuser according to the invention with withdrawal and blowing of air on a blade.

A longitudinal groove 62 now appears on the longitudinal sectional view of FIG. 3*a* and the view from above 3*b*. This groove opens onto the trailing edge 6*f*, without opening onto the leading edge 6*a*. This groove is produced by machining of the metal alloy material of the flank 6*p* of each blade 60, forming longitudinal walls 65, substantially parallel to the lower and upper surfaces 6*i* and 6*e*, and with a base 66 parallel to the flanks 6*p*.

Moreover, the blade 60 is provided with a series of orifices 63 opening into the air passage V between the blades 60 via of cylindrical blowing cavities 64. As illustrated by FIG. 3*b*, air streams F1 thus blown via the orifices 63 open onto the lower surface 6*i*. According to other embodiments, the streams F1 may also or alternatively open onto the upper surface 6*e*. In the example, the orifices 63 are aligned parallel to the leading edges 6*a* and the trailing edges 6*f*.

These cavities for blowing air 64 are inclined downstream by an angle of between 0 and 90°, for example of 30°, with respect to the mean curvilinear abscissa Sm of the blade. The streams F1 emerge through the orifices 63 and blow downstream into the air passage V. Thus a part of these streams as well as other streams coming from adjacent blades are drawn in, in the form of streams Fi, from the air passage V towards the groove 62 in the trailing edge 6*f* zone (in the region of the trailing edge 6*f* in the illustrated example).

The streams Fi are then injected by suction into the groove 62 of the blade 60 on the upstream side where the pressure is lower. The recirculation of the air streams via the groove between the trailing edge 6*f* and the leading edge 6*a* zones produces an intake/blowing coupling. The re-energisation of the incoming air streams then makes it possible to stabilise these streams and to prevent the separation thereof or optionally to recombine them if the separation has been initiated. The intake on the trailing edge, or in zones close to the trailing edge, likewise make it possible to mitigate—in fact to eliminate—the zones which are potentially still separated.

Alternatively, the cavities may open on the upper surface 6*e*, and/or these cavities can be replaced by one or more slots formed on a flank 6*p*. Grooves can also be machined on the two opposing flanks 6*p*, whilst retaining a central base portion 66 of the grooves.

Figure 3B:
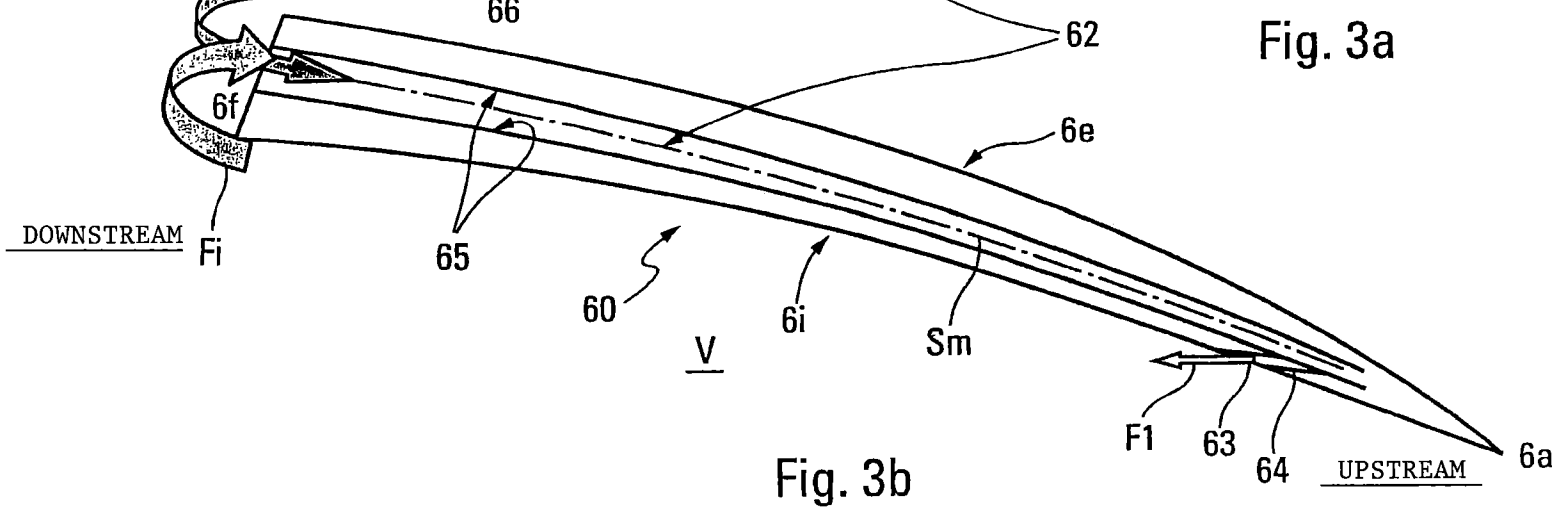
Figures 4A, 4B:
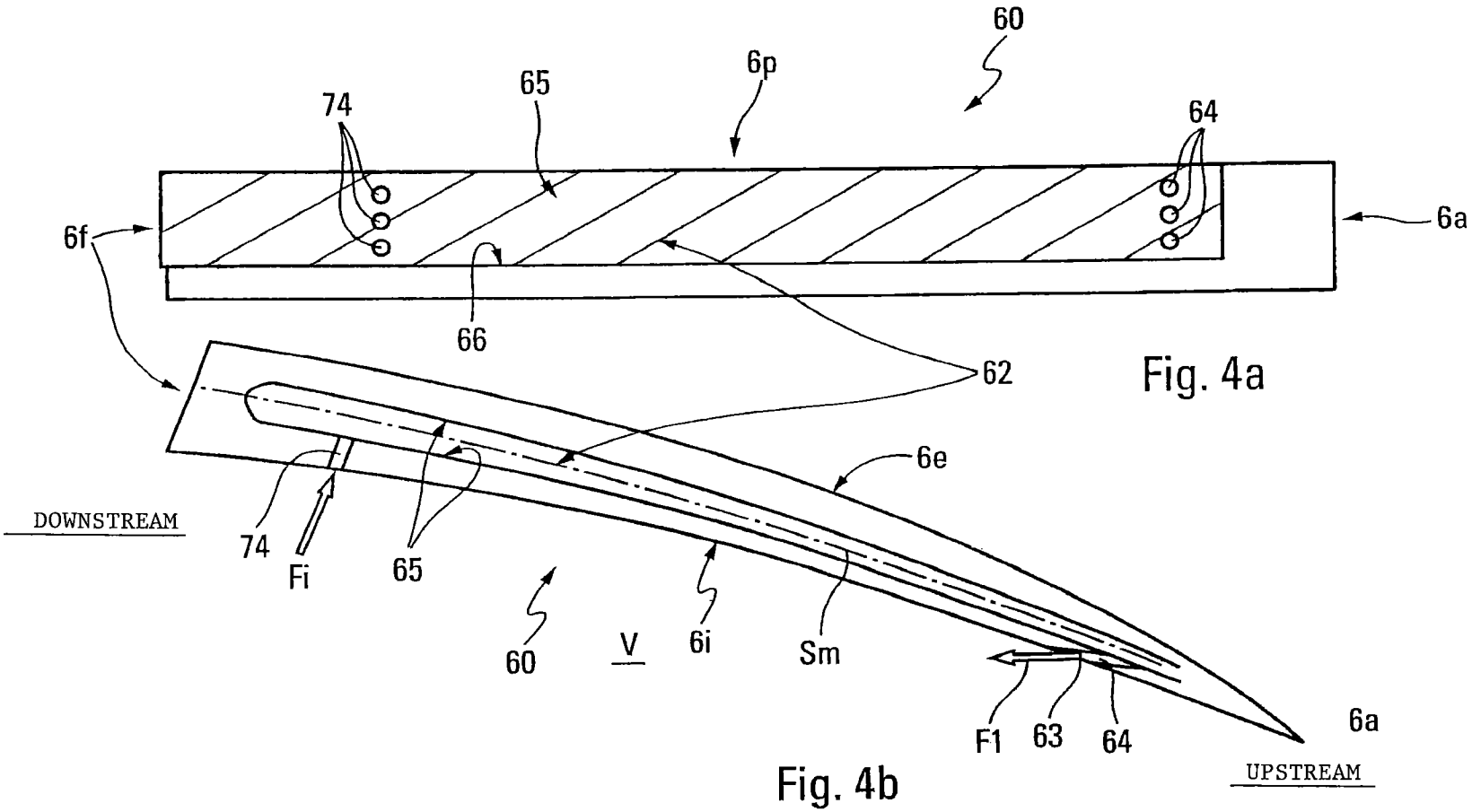
FIGS. 4*a* and 4*b* show schematic views in longitudinal section and from above of a second example of a diffuser with withdrawal and blowing of air on a blade according to the invention.

With reference to FIGS. 4*a* and 4*b* a second example of a diffuser with withdrawal and blowing of air on a blade is illustrated by views identical to FIGS. 3*a* and 3*b*. FIGS. 4*a* and 4*b* use the reference signs of FIGS. 3*a* and 3*b*, which signs refer to the same elements already defined in the previous passages, with reference respectively to FIGS. 3*a* and 3*b*.

The difference between this example and the first example of the diffuser relates to the means of drawing the air stream Fi into the groove 62 in the region of the trailing edge 6*f*. According to this second example, the streams Fi are reinjected via cavities 74 produced in the lower surface 6*i* of the trailing edge 6*f* and opening into the groove 62. The intake cavities are substantially transverse in the illustrated example. Alternatively, they can be inclined by an angle close to ±90° with respect to the normal to the curvilinear abscissa Sm of the blade 60 depending on the configurations. They can also be replaced by slots like the blowing cavities 64.

Figure 5:
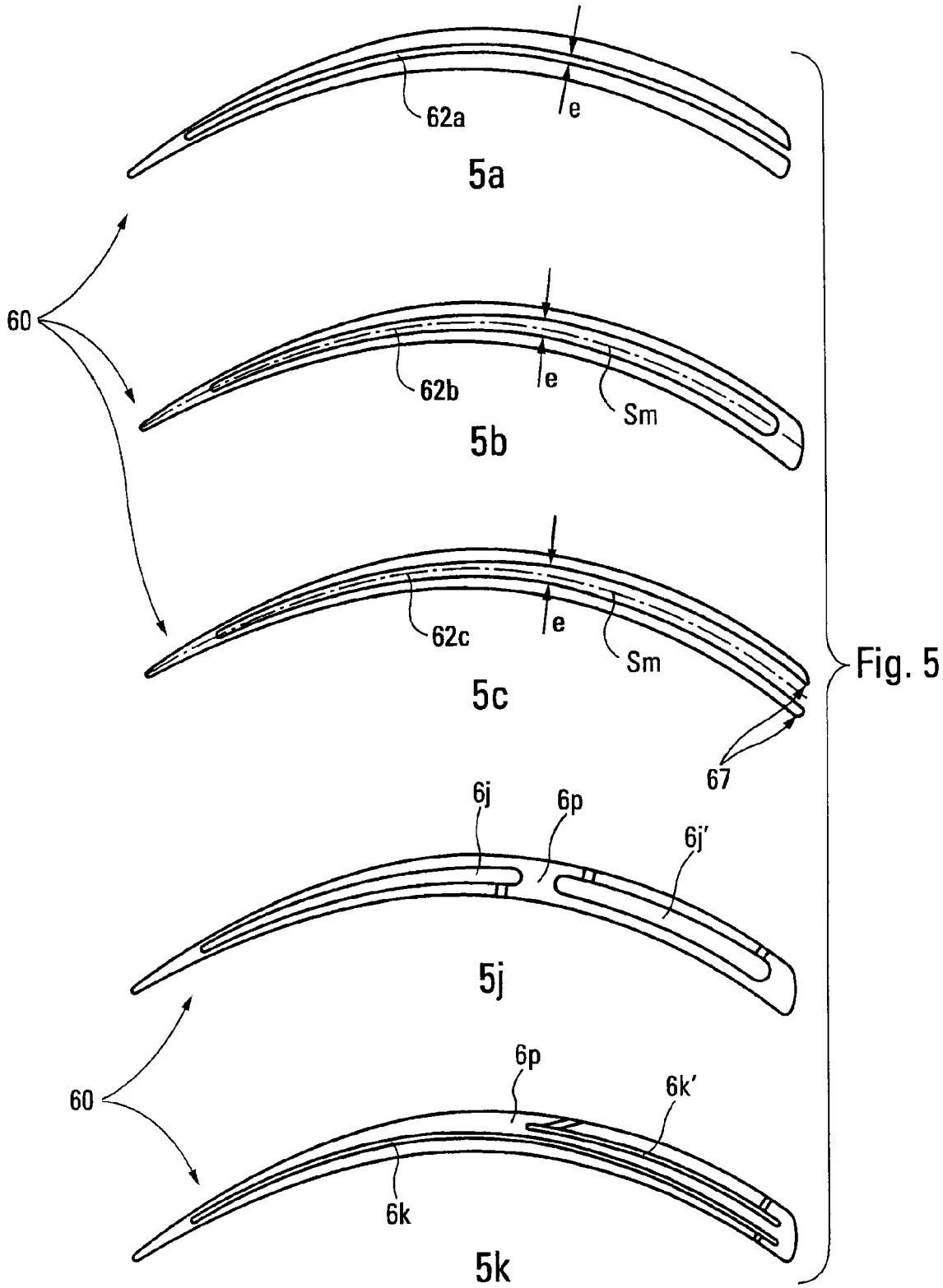
FIG. 5 shows views from above of variants of blades of the first and second examples according to diagrams 5*a* to 5*i*.
Figure 5:
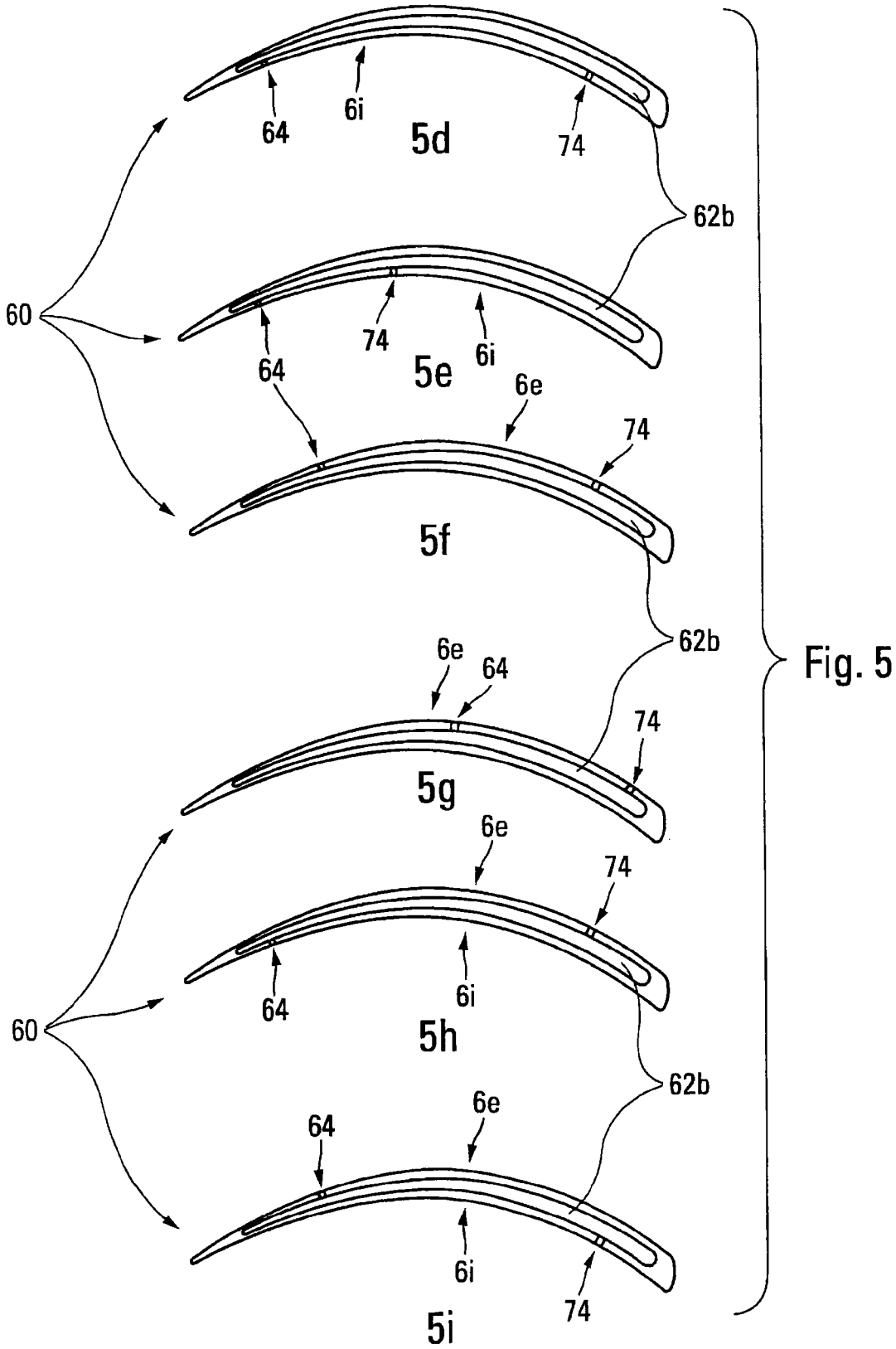

Other variants for these first and second examples are illustrated in the diagrams 5*a* to 5*k* of FIG. 5. These diagrams show a blade 62 viewed from above.

The diagrams 5*a* to 5*c* relate to blades 60 of grooves 62*a* to 62*c* respectively of constant width "e" and opening onto the trailing edge 6*f* (groove 62*a*, diagram 5*a*), or of linearly variable width "e" as a function of the mean curvilinear abscissa Sm of the blade 60 (grooves 62*b* and 62*c*, diagrams 5*b* and 5*c*). The groove may be a through groove (groove 62*a* and 62*c*, diagrams 5*a* and 5*c*) or a blind groove (groove 62*b*, diagram 5*b*) on the trailing edge 6*f*. When the groove is a through groove, the trailing edge 6*f* then has shaped rims 67 in order to optimise the intake of air.

Moreover, the intake cavities 74 and injection cavities 64 can open onto the same faces: the lower surface 6*i* (diagrams 5*d* and 5*e*) or the upper surface 6*e* (diagrams 5*f* and 5*g*). They can also open onto different faces: the upper surface 6*e* for the intake cavities 74 and the lower surface 6*i* for the re-injection cavities 64 (diagram 5*h*), or the lower surface 6*i* for the intake cavities 74 and the upper surface 6*e* for the re-injection cavities 64 (diagram 5*i*). The diagrams 5*d* to 5*i* show a blind groove 62*b* of linearly increasing width.

Furthermore, the cavities or slots may be positioned and open at any point on the length of the groove, with angles which can tend towards ±90° with respect to the normal to the curvilinear abscissa of the blade.

The grooves can in general extend over the entire length of the blade 60 or over a minimal length, close to 0% of the total length.

Moreover, a plurality of grooves can be machined on one and the same flank 6*p*, for example two grooves, as illustrated in diagrams 5*j* and 5*k*. In diagram 5*j* the grooves 6*j* and 6*j*' follow one another along the blade 60. In diagram 5*k* the grooves 6*k* and 6*k*' are substantially parallel along the blade 60.

Figure 6A:
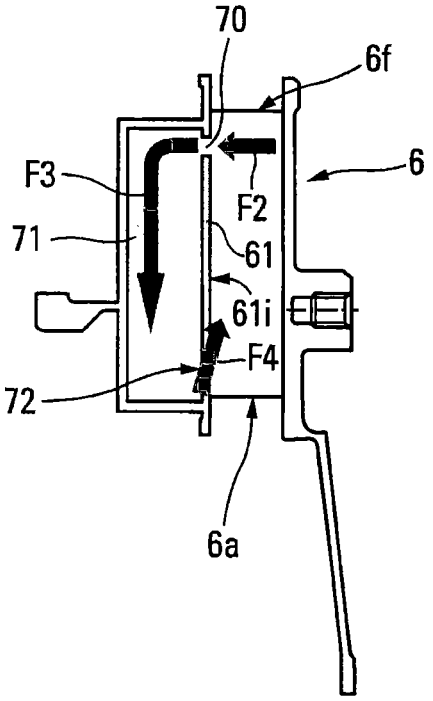
FIGS. 6*a* and 6*b* show a schematic front view and an enlarged view of an end plate of an example of a diffuser with withdrawal and blowing on an end plate.

Moreover, FIG. 6*a* illustrates a front view of a third example of a diffuser 60 according to the invention. In this example, the withdrawal of air—still performed in the zone of the trailing edge 6*f* of the diffuser 6 (arrow F2) is effected by suction through an opening 70 produced radially in the end plate 61. The air streams F3 are redirected upstream in a casing housing 71 substantially parallel to the diffuser 6, this housing 71 and the diffuser 6 having the end plate 61 as a common wall. The blowing is achieved by re-injection of the streams F4 along the internal face 61*i* of the end plate 61 through holes 72 formed in the zone of the leading edge 6*a* of the diffuser 6.

Figure 6B:
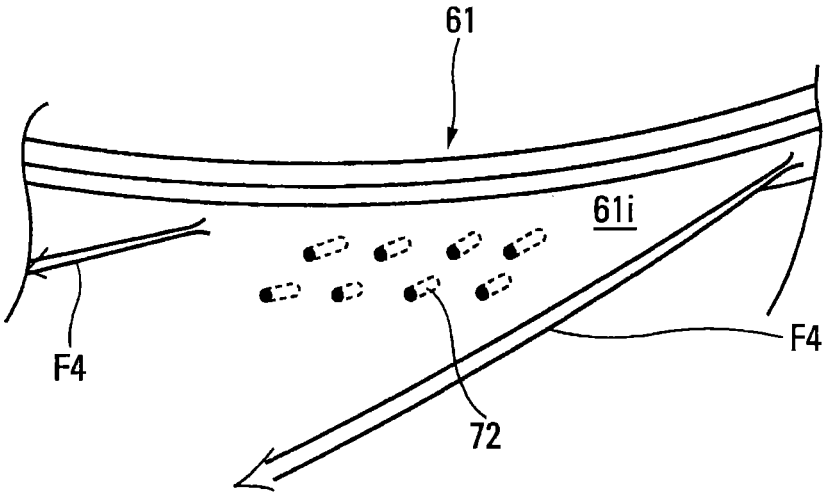

The holes 72 are inclined in relation to the end plate 61, as appears more precisely with reference to the enlarged diagram of FIG. 6*b*. The diffusion of the air streams F4 is thus reinjected on the face 61*i* of the end plate 61 situated on the inner side of the diffuser 6. The re-energisation of the zones of air flows with little movement is then favoured on the leading edge of the diffuser.

The invention is not limited to the examples described and illustrated. Thus the cavities and slots are not necessarily cylindrical or partially cylindrical but may be of varied cross-section: prismatic, oblong, etc. Moreover, when the withdrawal and the re-injection of air is effected through the end plate, the transit housing can be formed in the casing or in the hub of the diffuser.

The invention claimed is:

1. A method of blowing air in a compression stage diffuser of a compressor of a gas turbine, the diffuser including two end plates enclosing a blade and an air flow from a leading edge to a trailing edge of the blade, the method comprising:

coupling a blowing of air into an air passage, the air passage being upstream of the diffuser, via a blowing cavity at the leading edge with a withdrawal of air at a downstream portion of the air passage, the coupling including blowing the withdrawn air into the air passage from upstream to downstream, the blowing being oriented so that the withdrawn air flows along at least one of the blade and the end plates; and withdrawing the air from the air passage by suction into an intake opening, the intake opening being closer to the trailing edge than to the leading edge, and the withdrawn air is blown out via the blowing cavity in the leading edge of the blade to produce the coupling, so that a pressure of the air that is withdrawn is substantially higher than a pressure of air flowing in a region of the withdrawal, wherein the blade includes an upper surface corresponding to one of a pressure side or a suction side of the blade and a lower surface corresponding to the other of the pressure side or the suction side of the blade, the upper and lower surfaces extending longitudinally and substantially parallel to a mean surface of the blade, the leading edge and the trailing edge connecting the upper surface and the lower surface of the blade.

2. The method of blowing according to claim 1, wherein the air is withdrawn either downstream of the diffuser, in a grille of the stage of the compressor, or in the diffuser, or near to the trailing edge of the blade.

3. The method of blowing according to claim 1, wherein the withdrawal of air is performed on at least one of the lower and upper surfaces of the blade, and the blowing is on the blades.

4. The method of blowing according to claim 1, wherein the withdrawal is performed on at least one of a hub and casing end plates of the diffuser, and the blowing is on the end plates.

5. The method of blowing according to claim 1, wherein the withdrawal is performed on the blades and the blowing is on the end plates.

6. The method of blowing according to claim 1, wherein the withdrawal is performed on the end plates and the blowing is on the blades.

7. The method according to claim 1, wherein the trailing edge of the blade is free of any opening.

8. The method according to claim 1, wherein the air passage extends along the blade between the blowing cavity and the intake opening.

9. A diffuser of a compressor of the centrifugal or mixed type of a gas turbine, comprising:

two end plates enclosing a plurality of circumferential blades, each of the blades including an upper surface corresponding to one of a pressure side or a suction side of the blade and a lower surface corresponding to the other of the pressure side or the suction side of the blade, the upper and lower surfaces extending longitudinally and substantially parallel to a mean surface of the blade, a leading edge and a trailing edge connecting the upper surface and the lower surface, wherein a blowing cavity is provided in at least one of the blades and one of the end plates, the blowing cavity blows air into an air passage from upstream to downstream and is situated in a leading edge zone, wherein an intake opening is formed along at least one of the blades and on an internal face of the end plate, the intake opening being closer to the trailing edge than to the leading edge, and wherein air withdrawn from the air passage by suction into the intake opening is blown out via the blowing cavity to produce a coupling.

10. A diffuser of a compressor according to claim 9, wherein the blowing cavity is formed in at least one of the lower and upper surfaces of the blades and opens towards the intake opening.

11. A diffuser of a compressor according to claim 9, wherein the blowing cavity and intake opening are formed by at least one of cavities and slots.

12. A diffuser of a compressor according to claim 11, wherein the blowing cavity and the intake opening have a central axis inclined with respect to normal to the face onto which the blowing cavity and the intake opening open, with an angle substantially between 0 and ±90°.

13. A diffuser of a compressor according to claim 11, wherein the blowing cavity and the intake opening are positioned along at least one of the upper and lower surfaces of the blades, with a groove connecting the blowing cavity and the intake opening.

* * * * *